US010247470B2

(12) United States Patent
Park et al.

(10) Patent No.: US 10,247,470 B2
(45) Date of Patent: Apr. 2, 2019

(54) REFRIGERATOR WITH REMOVABLE DISPLAY

(71) Applicant: SAMSUNG ELECTRONICS CO., LTD., Suwon-si (KR)

(72) Inventors: Jong Sun Park, Gwangju (KR); Byoung Jae Cho, Gwangju (KR); Hyo Sik Kang, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 603 days.

(21) Appl. No.: 14/454,083

(22) Filed: Aug. 7, 2014

(65) Prior Publication Data

US 2015/0052920 A1 Feb. 26, 2015

(30) Foreign Application Priority Data

Aug. 22, 2013 (KR) ..... 10-2013-0099483

(51) Int. Cl.
*F25D 23/02* (2006.01)
*F25D 29/00* (2006.01)

(52) U.S. Cl.
CPC ..... *F25D 29/003* (2013.01); *F25D 23/028* (2013.01); *F25D 29/005* (2013.01); *F25D 2323/021* (2013.01); *F25D 2400/361* (2013.01)

(58) Field of Classification Search
CPC .... F25D 29/003; F25D 29/005; F25D 23/006; F25D 23/028; F25D 23/04; F25D 23/10; F25D 2400/361
See application file for complete search history.

(56) References Cited

U.S. PATENT DOCUMENTS 6,101,819 A * 8/2000 Onaka ..... F25D 29/005 337/327
2001/0052741 A1* 12/2001 Yun ..... F16M 11/10 312/405
2006/0145576 A1* 7/2006 Lee ..... F16M 11/04 312/406
2006/0261220 A1 11/2006 Lee et al.
2007/0086151 A1* 4/2007 Oh ..... F16M 11/041 361/679.01

FOREIGN PATENT DOCUMENTS

DE 202007006099 1/2008
JP 2-105757 4/1990
JP 2002-243354 8/2002
WO WO 2006068456 A1 * 6/2006 ..... F16M 11/04
WO WO 2012073943 A1 * 6/2012 ..... H04N 5/64

OTHER PUBLICATIONS

Extended European Search Report dated Apr. 1, 2015 in European Patent Application No. 14180802.2.
European Office Communication dated Jan. 18, 2017 in European Patent Application No. 14180802.2.

* cited by examiner

*Primary Examiner* — Cassey D Bauer
(74) *Attorney, Agent, or Firm* — Staas & Halsey LLP

(57) ABSTRACT

A refrigerator includes a body having a storage compartment, a door that opens and closes the storage compartment, and a display unit separably provided on a front side of the door. If one side of the display unit is inserted into an inner side of the front side of the door due to rotation, the other side of the display unit is provided to protrude toward a front of the door. With this configuration, the display unit can be easily separated from the door.

17 Claims, 10 Drawing Sheets

REFRIGERATOR WITH REMOVABLE DISPLAY

CROSS-REFERENCE TO RELATED APPLICATIONS

This application claims the priority benefit of Korean Patent Application No. 10-2013-0099483, filed on Aug. 22, 2013 in the Korean Intellectual Property Office, the disclosure of which is incorporated herein by reference.

BACKGROUND

1. Field

The following description relates to a display unit of a refrigerator, and more particularly, to a disassembling structure of a display unit of a refrigerator.

2. Description of the Related Art

In general, a refrigerator is a home appliance that keeps food fresh by including a storage compartment for storing food, and a cold air supplying unit for supplying cold air to the storage compartment.

A front side of the storage compartment through which food can be put in or taken out, is provided to be open, and the open front side may be opened and closed by a door.

As home appliances have recently become more advanced, refrigerators including a display unit having an input/output function have been developed and released. The display unit is equipped with an output function in which signals received from an external device or a refrigerator controller are visually output on a screen, and an input function in which a user's manipulation can be performed through the display unit. The display unit is generally disposed on a front side of the door for the user's convenience.

However, according to the related art, the display unit is separated from the door using an additional separation unit or using the front side of the door as a lever. As a result, there are inconveniences as additional components are required and the front side of the door is damaged.

SUMMARY

Therefore, it is an aspect of the present disclosure to provide a refrigerator in which a display unit can be solidly mounted and can be easily separated from a door.

Additional aspects of the disclosure will be set forth in part in the description which follows and, in part, will be obvious from the description, or may be learned by practice of the disclosure.

In accordance with an aspect of the present invention, a refrigerator includes: a body having a storage compartment; a door that opens/closes the storage compartment; and a display unit separably provided on a front side of the door, if one side of the display unit is inserted into an inner side of the front side of the door due to rotation, the other side of the display unit being provided to protrude toward a front of the door.

The display unit may include: a first portion inserted into the inner side of the front side of the door due to an external force; and a second portion that protrudes toward the front of the door if the first portion is inserted into the inner side of the front side of the door.

The refrigerator may further include a display case on which the display unit is mounted and which is formed concave from the front side to an inner side of the door.

The display case may include a rotation support portion provided to correspond to a rear side of the display unit to support rotation of the display unit.

The display case may include: a first bottom surface formed from the front side of the door to a first depth and a second bottom surface extending from the first bottom surface in a lengthwise direction of the display case and being formed to a second depth larger than the first depth.

The display case may further include at least one mounting support portion which is provided on the first bottom surface and on which at least a portion of the rear side of the display unit is mounted.

The display unit may include at least one coupling protrusion through which the display unit is combined with the display case.

The at least one coupling protrusion may include an insertion prevention protrusion that is formed to be bent from the display unit and has an insertion prevention hanging jaw formed to face the inner side of the door.

The display unit may include: a first portion inserted into the inner side of the front side of the door; and a second portion that protrudes toward the front of the door, and the insertion prevention protrusion may be provided in the first portion.

The at least one coupling protrusion may include a separation prevention protrusion that is formed to be bent from the display unit and has a separation prevention hanging jaw formed to face an outer side of the door.

The display unit may include: a first portion inserted into the inner side of the front side of the door; and a second portion that protrudes toward the front of the door, and the separation prevention protrusion may be provided in the second portion.

The display case may include: a case bottom surface provided more concave than the front side of the door; a case side surface that connects the case bottom surface and the front side of the door; and at least one coupling groove provided in the case side surface to correspond to the at least one of coupling protrusions.

The display unit may include a front surface portion exposed to the front side of the door, and the front surface portion may be provided parallel to the front side of the door.

The display case may include a case opening provided in the front side of the door and formed to be opened and closed by the display unit, and a width of the case opening may correspond to a width of the front surface portion of the display unit exposed to the front side of the door.

In accordance with an aspect of the present disclosure, a refrigerator may include a body having an opening formed therein; a door that opens and closes the opening; and a display assembly provided at a front side of the door, wherein the display assembly may include: a display unit exposed to the front side of the door and provided to be separable from the door; and a display case which is provided more concave than the front side of the door and on which the display unit is separably mounted.

The display case may include a case bottom surface having a first bottom surface formed to a first depth with respect to the front side of the door and a second bottom surface formed to a second depth that is larger than the first depth.

The display case may further include a rotation support portion that protrudes toward a front of the case bottom surface and supports rotation of the display unit.

The display unit may include: a rotation insertion portion mounted on a front of the first bottom surface; and a rotation protrusion portion that is provided parallel to the rotation insertion portion in a lengthwise direction of the display unit and mounted on a front of the second bottom surface.

The display unit may be rotated when an external force is applied to the rotation insertion portion toward the second bottom surface.

The display unit may include an insertion prevention protrusion that is formed to be bent from the rotation insertion portion and has an insertion prevention hanging jaw formed to face an inner side of the door.

The display unit may include a separation prevention protrusion that is formed to be bent from the rotation protrusion portion and has a separation prevention hanging jaw formed to face a front of the door.

In accordance with an aspect of the present disclosure, a refrigerator may include a body having an opening formed therein; a door that opens and closes the opening; and a display assembly provided at a front side of the door, wherein the display assembly may include: a display case provided concave toward an inner side from the front side of the door; and a display unit mounted on the display case, if one side of the display unit is pressed due to an external force, the other side of the display unit being separated from a front of the door and being provided separable from the display case.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
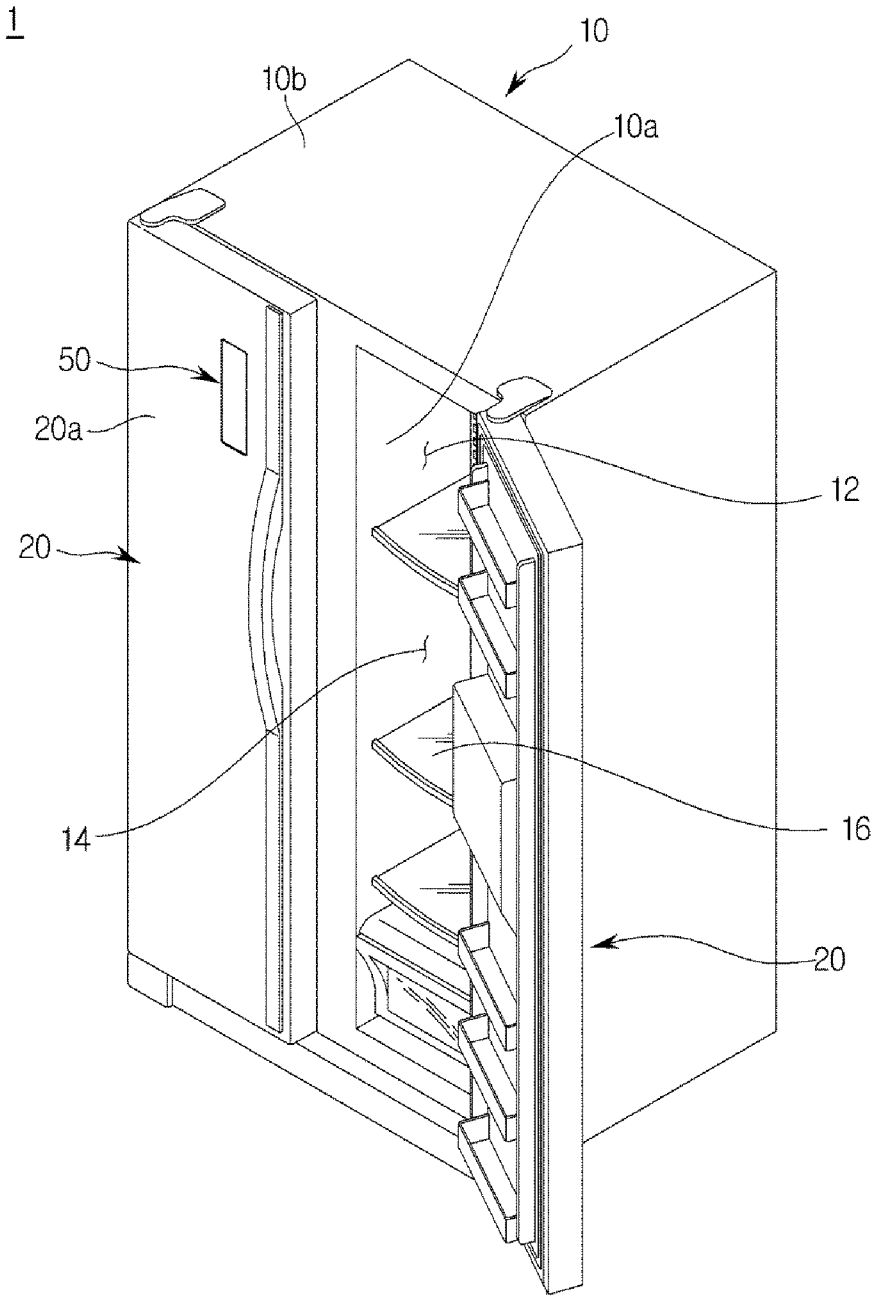
FIG. 1 is a perspective view of a refrigerator in accordance with an embodiment of the present disclosure.

Reference will now be made in detail to the embodiments of the present disclosure, examples of which are illustrated in the accompanying drawings, wherein like reference numerals refer to like elements throughout. The embodiments are described below to explain the present disclosure by referring to the figures.

FIG. 1 is a perspective view of a refrigerator in accordance with an embodiment of the present disclosure.

As illustrated in FIG. 1, a refrigerator 1 includes a body 10 that constitutes an exterior, a storage compartment 14 provided inside the body 10 and having an opening 12 through which a front side 20*a* of the storage compartment 14 is opened, and a door 20 that is rotatably combined with the body 10 to open and close the opening 12 of the storage compartment 14.

The body 10 includes an inner case 10*a* that constitutes the storage compartment 14, an outer case 10*b* that constitutes an exterior, and a heat insulating material (not shown) disposed between the inner case 10*a* and the outer case 10*b*.

A cold air supplying unit (not shown) includes a compressor (not shown), a condenser (not shown), an expansion valve (not shown), and an evaporator (not shown), and may circulate a refrigerant and generate cold air using latent heat of evaporation.

The opening 12, through which food can be put in or taken out, may be formed in the front side 20*a* of the storage compartment 14 and may be opened and closed by the door 20. The storage compartment 14 may be provided so that a space of the storage compartment 14 can be partitioned by a plurality of trays 16.

A display assembly 50 may be provided in the front side 20*a* of the door 20. The display assembly 50 may be provided to output a state of an internal space of the storage compartment 14 to be watched from an outer side of the refrigerator 1, or so that a user can input instructions via the display assembly 50. To this end, the display assembly 50 may include a touchpad. The display assembly 50 will now be described in detail.

Figure 2:
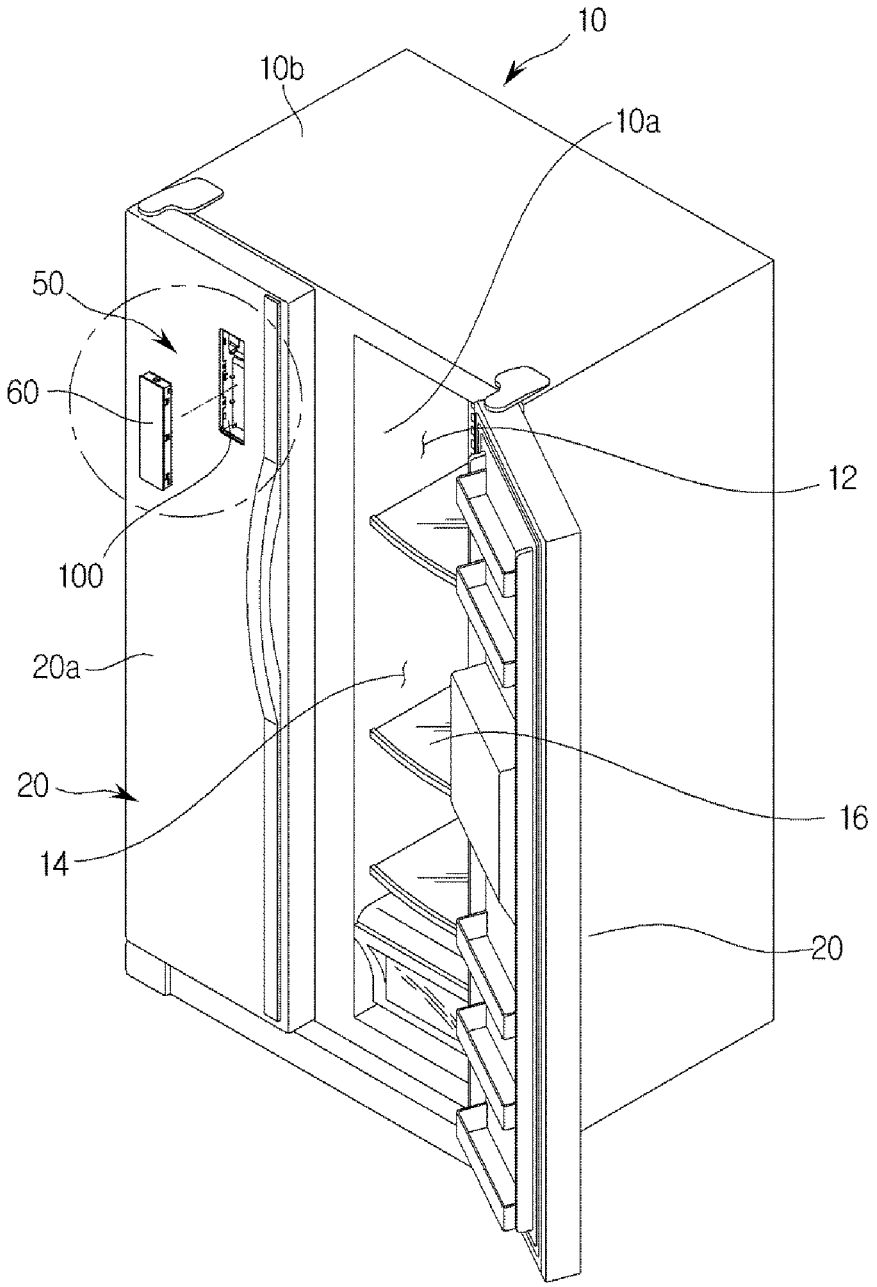
FIG. 2 is a perspective view of a display assembly of the refrigerator illustrated in FIG. 1.
Figure 3:
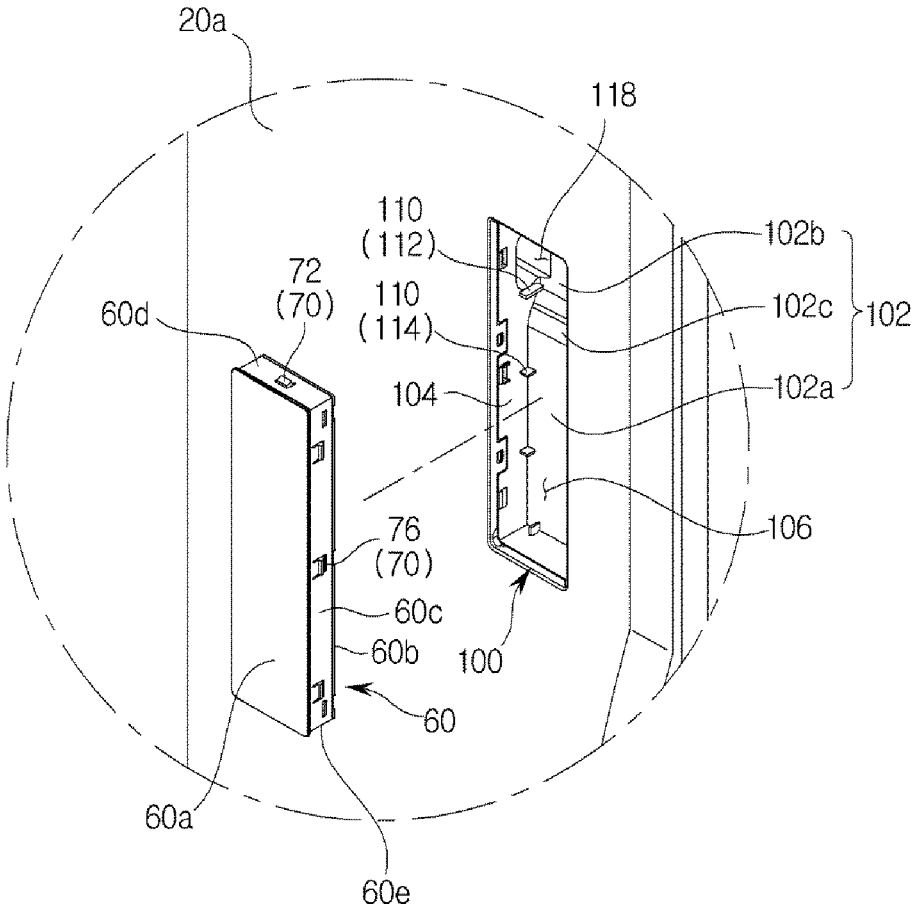
FIG. 3 is an exploded perspective view of the display assembly of the refrigerator of FIG. 1.
Figure 4:
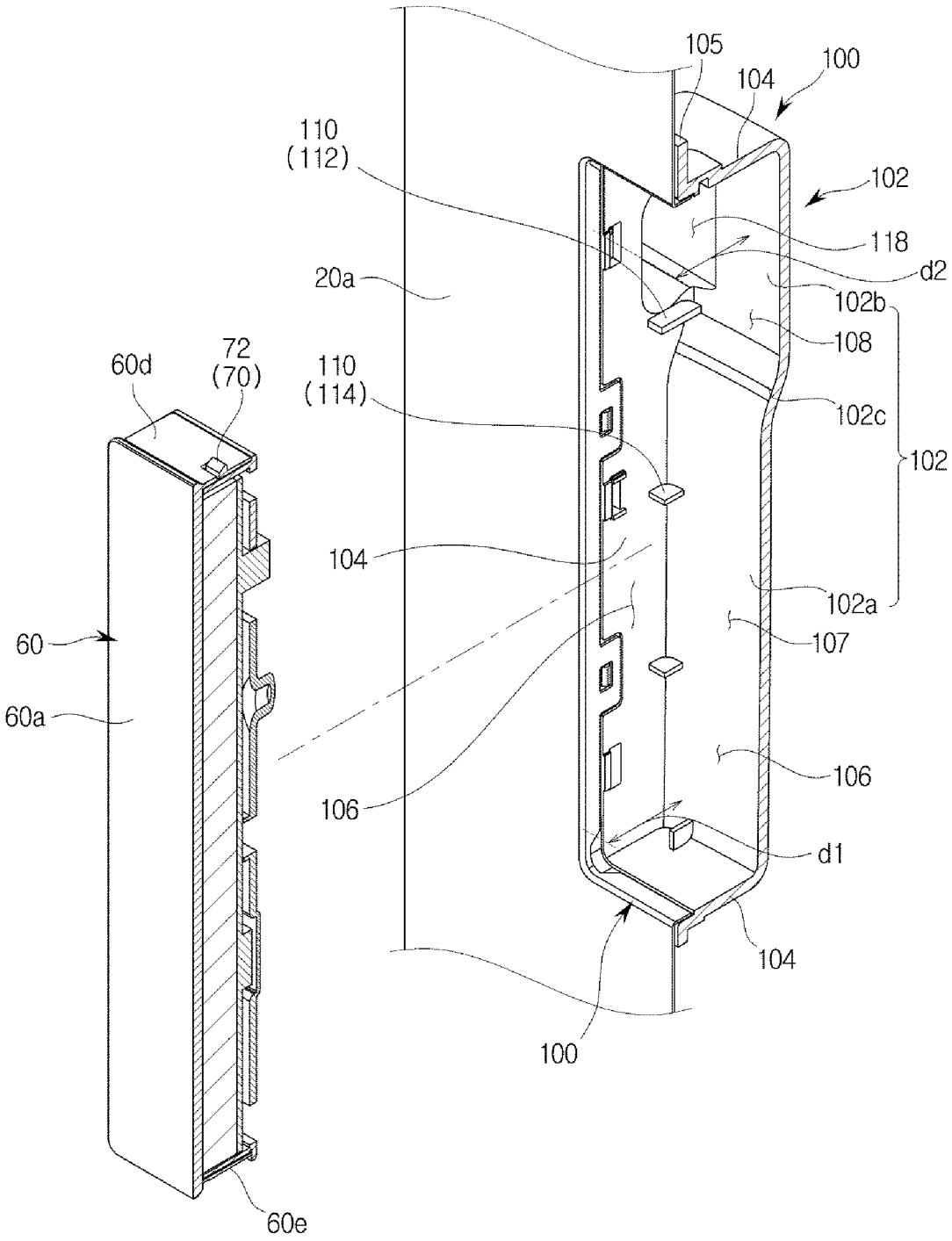
FIG. 4 is a cross-sectional perspective view of the display assembly of the refrigerator of FIG. 1.

FIG. 2 is a perspective view of a display assembly of the refrigerator illustrated in FIG. 1, FIG. 3 is an exploded perspective view of the display assembly of the refrigerator of FIG. 1, and FIG. 4 is a cross-sectional perspective view of the display assembly of the refrigerator of FIG. 1.

As illustrated in FIGS. 1 and 2, the display assembly 50 may be provided at the front side 20*a* of the door 20.

The display assembly 50 may include a display unit 60. The display unit 60 is provided to be separated from the door 20 or from a display case 100 that will be described below.

The display unit 60 is provided to be mounted on the front side 20*a* of the door 20, and due to rotation, one side of the display unit 60 is inserted into an inner side of the front side 20*a* of the door 20, and the other side of the display unit 60 protrudes toward a front of the door 20 so that the display unit 60 can be separated from the door 20. The display unit 60 may be mounted directly on the front side 20*a* of the door 20. However, the display unit 60 may also be inserted into the display case 100 that will be described below and mounted thereon.

The display unit 60 is formed so that the front side 20*a* includes a touchpad, and is provided to transmit instructions to a controller (not shown) through input via the touchpad or to output information regarding a state or control of the inner side of the refrigerator 1 to the front side 20*a*.

As illustrated in FIG. 2, the display unit 60 may be provided to be separable or removable from the door 20 such that the display unit 60 can be easily maintained. The display unit 60 may be provided to be separated from the door 20 by rotation.

The display unit 60 may include a first portion 61 inserted into an inner side of the front side 20*a* of the door 20 by rotation and a second portion 62 that protrudes toward the front of the door 20. The first portion 61 and the second portion 62 may be provided in the same plane along a lengthwise direction of the display unit 60. In detail, the display unit 60 may include the first portion 61 that is provided at one side of the display unit 60 and is pushed toward an inner side of the door 20, and the second portion 62 which is provided at the other side of the display unit 60 based on a point that is a center of rotation and to which a force protruding toward an outer side of the door 20 is transferred due to a principle of a lever. The first portion 61 and the second portion 62 may be referred to as a rotation insertion portion 61 a and a rotation protrusion portion 62*a*.

In order to rotate the display unit 60, a larger separation pressing force F than a force for touching the touchpad is generated in the first portion 61. The separation pressing force F is a sufficiently large force in which coupling protrusions 70 that will be described below are separated from coupling grooves 120.

The display unit 60 may include a front surface portion 60*a* exposed to the front side 20*a* of the door 20, a rear surface portion 60*b* that is provided at an opposite side to the front surface portion 60*a* and faces a case bottom surface 102 of the display case 100, and a side surface portion 60*c* that connects the front surface portion 60*a* and the rear surface portion 60*b*. The side surface portion 60*c* may include a top surface portion 60*d* provided at an upper part of the display unit 60 and a bottom surface portion 60*e* provided at a lower part of the display unit 60.

The front surface portion 60*a* of the display unit 60 may be provided parallel to the front side 20*a* of the door 20, as illustrated in FIG. 1. In other words, the front surface portion 60*a* of the display unit 60 may be provided to be flush with the front side 20*a* of the door 20.

Also, the front surface portion 60*a* of the display unit 60 may be provided so that no gap, or a minimal gap, may be formed between the front surface portion 60*a* of the display unit 60 and the front side 20*a* of the door 20. In other words, the display case 100 disposed on the front side 20*a* of the door 20 may include a case opening 106 that is provided at the front side 20*a* of the door 20 and formed to be opened and closed by the display unit 60. A width of the case opening 106 may be provided to correspond to a width of the front surface portion 60*a* of the display unit 60 exposed to the front side 20*a* of the door 20.

Through this configuration, an aesthetic appeal of arrangement of the display unit 60 can be improved so that a user views the display unit 60 and the door 20 as the same configuration. In terms of maintenance, a gap or protrusion structure between the display unit 60 and the door 20 is removed so that foreign substances can be prevented from being accumulated between the display unit 60 and the door 20.

The display assembly 50 may further include the display case 100.

The display case 100 as a separate configuration may also be coupled to the inner side of the front side 20*a* of the door 20 and may also be integrated with the front side 20*a* of the door 20. In the current embodiment of the present disclosure, the display case 100 is provided as a separate configuration from the front side 20*a* of the door 20.

The display case 100, on which the display unit 60 is mounted, may be formed inwardly concave from the front side 20*a* of the door 20. The display case 100 may be integrated with the door 20 or may be provided as a separate configuration and combined with the door 20.

The display case 100 may include the case bottom surface 102 and a case side surface 104.

The case bottom surface 102 is provided to be more concave toward the inner side of the door 20 than the front side 20*a* of the door 20 and may be formed to be at a depth at least larger than a thickness of the display unit 60 based on the front side 20*a* of the door 20. The case bottom surface 102 may be formed to face the rear surface portion 60*b* of the display unit 60.

The case bottom surface 102 may include a first bottom surface 102*a* and a second bottom surface 102*b*.

The first bottom surface 102*a* is a bottom surface formed from the front side 20*a* of the door 20 to a first depth d1, and the second bottom surface 102*b* is a bottom surface formed to a second depth d2 that is larger than the first depth d1.

The display case 100 may further include the case opening 106 that is opened toward the front of the door 20 so that the display unit 60 can be detached from the display case 100.

A mounting space 107, in which the display unit 60 is mounted, may be formed between the first bottom surface 102*a* and the case opening 106, and a rotation space 108, in which the display unit 60 is rotated to be separated, may be formed between the second bottom surface 102*b* and the case opening 106.

The case bottom surface 102 may include a bent, or inclined, surface 102*c* that connects the first bottom surface 102*a* and the second bottom surface 102*b*. Because the first bottom surface 102*a* and the second bottom surface 102*b* are formed to have different depths from the front side 20*a* of the door 20, the bent surface 102*c* may be provided to connect the first bottom surface 102*a* and the second bottom surface 102*b*.

Sides of the display unit 60 may be combined with the case side surface 104 as a surface that connects the case bottom surface 102 and the front side 20*a* of the door 20. Combining the display case 100 and the display unit 60 will now be described in detail.

The display case 100 may further include a support portion 110 to mount or rotate the display unit 60.

The support portion 110 is provided at an inner side of the display case 100 and may include a rotation support portion 112 and at least one mounting support portion 114.

The rotation support portion 112 is provided at the display case 100 to correspond to a rear side of the display unit 60 to support rotation of the display unit 60. That is, the rotation support portion 112 may be a border between the first portion 61 and the second portion 62 of the display unit 60, and a pressing force generated in the first portion 61 causes rotation of the display unit 60 due to the rotation support portion 112, and the display unit 60 is provided to be separated from the display case 100 or the door 20 due to a principle of a lever.

The rotation support portion 112 may be provided on the case bottom surface 102 of the display case 100. In detail, the rotation support portion 112 may be provided adjacent to a border between the first bottom surface 102*a* and the second bottom surface 102*b* to support the display unit 60 on the case bottom surface 102 by rotation.

In the current embodiment of the present disclosure, the rotation support portion 112 has a rib shape to be perpendicular to the lengthwise direction of the display unit 60. However, embodiments of the present disclosure are not limited thereto, and the rotation support portion 112 may have a shape in which the display unit 60 may be supported by rotation.

The mounting support portions 114 are provided in the display case 100 to support mounting of the display unit 60 and to correspond to the rear side of the display unit 60. That is, the mounting support portions 114 may be provided in the first bottom surface 102*a* so that at least a portion of the second portion 62 of the display unit 60 can be mounted on the mounting support portions 114.

In the current embodiment of the present disclosure, each of the mounting support portions 114 has a rib shape to be perpendicular to the lengthwise direction of the display unit 60. However, embodiments of the present disclosure are not limited thereto, and the mounting support portions 114 may be provided to support mounting of the display unit 60.

The display case 100 may further include a wire hole 118 through which a wire that exchanges electrical signals with the display unit 60 may pass. The wire may connect the controller (not shown) provided inside the refrigerator 1 and the display unit 60 to exchange the electrical signals. A shape and a position of the wire hole 118 are not limited thereto, and in the current embodiment of the present disclosure, the wire hole 118 is provided in the case side surface 104. However, the disclosure is not limited to a wired configuration. The display unit may be provided in a wireless configuration, or attached to a power and communication port in the display case, such that a wire hole 118 is unnecessary, for example.

The display case 100 may further include a coupling flange 105. The coupling flange 105 is provided to be coupled to the front side 20*a* of the door 20. That is, the coupling flange 105 is provided to be coupled to an inner side of the outer case 10*b* of the door 20.

Configurations of the coupling protrusions 70 and the coupling grooves 120 are associated with combination of the display unit 60 and the display case 100 and thus will now be described in detail.

Figure 5:
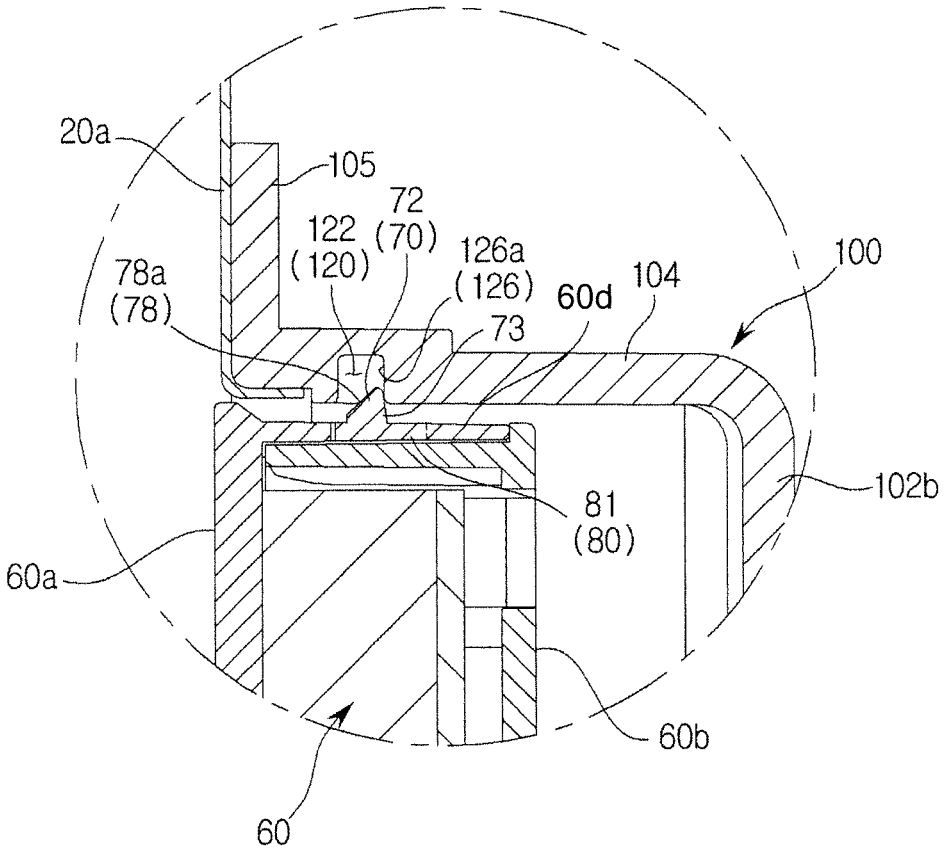
FIGS. 5 and 6 illustrate an operation of combining the display assembly of the refrigerator of FIG. 1.
Figure 6:
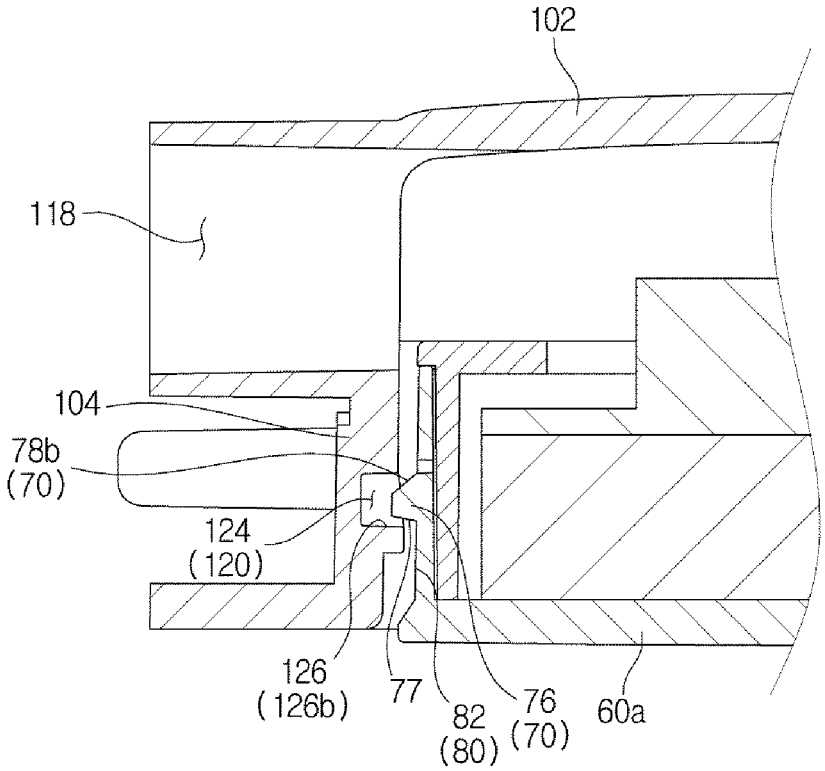

FIGS. 5 and 6 illustrate an operation of combining the display assembly 50 of the refrigerator 1 of FIG. 1.

The display unit 60 may include at least one coupling protrusion 70 through which the display unit 60 may be combined with the display case 100. In the current embodiment of the present disclosure, the coupling protrusions 70 are provided at the side surface portion 60*c*. However, embodiments of the present disclosure are not limited thereto.

Each of the coupling protrusions 70 may include an insertion prevention protrusion 72 and a separation prevention protrusion 76.

The insertion prevention protrusion 72 is configured so that rotation of the display unit 60 does not easily, or freely, occur after the display unit 60 is mounted on the display case 100.

In detail, in the current embodiment of the present disclosure, the first portion 61 of the display unit 60 is pressed so that rotation of the display unit 60 occurs and the display unit 60 is provided to be separable from the display case 100 or the door 20. The insertion prevention protrusion 72 is provided so that, in order to prevent the display unit 60 from being rotated due to a user's pressing force for touching the touchpad, a force is applied in an opposite direction to a direction of the pressing force applied to the first portion 61 of the display unit 60. Through this configuration, the insertion prevention protrusion 72 is provided so that rotation of the display unit 60 does not easily occur.

For this reason, the insertion prevention protrusion 72 may include an insertion prevention hanging jaw 73. The insertion prevention hanging jaw 73 may be formed to be bent, or inclined, from the display unit 60 and to face the inner side of the door 20. The insertion prevention hanging jaw 73 is configured to prevent the first portion 61 of the display unit 60 from being freely inserted into the display case 100 or the inner side of the door 20. In detail, the insertion prevention hanging jaw 73 may be provided so that, only when the insertion prevention hanging jaw 73 is hung in a case hanging jaw 126 of the display case 100 and a predetermined pressing force or more required for separation of the display unit 60 is generated, the first portion 61 of the display unit 60 can be inserted into the display case 100 or the inner side of the door 20. In the current embodiment of the present disclosure, the insertion prevention hanging jaw 73 is provided perpendicular to an insertion direction of the display unit 60. However, embodiments of the present disclosure are not limited thereto, and the insertion prevention hanging jaw 73 may be provided to merely prevent insertion of the first portion 61 of the display unit 60.

Also, the insertion prevention protrusion 72 may include a protrusion inclination surface 78. The protrusion inclination surface 78 may be provided to protrude from the side surface portion 60*c* to be inclined with respect to a direction in which the display unit 60 is inserted into the door 20. The protrusion inclination surface 78 may be provided so that the insertion prevention protrusion 72 may be easily coupled into a groove of the insertion prevention protrusion 72 that will be described below.

The insertion prevention protrusion 72 may be provided to protrude directly from the display unit 60. In the current embodiment of the present disclosure, an elastic support portion 80 may be provided to elastically support the insertion prevention protrusion 72. Because the elastic support portion 80 may also be provided on the separation prevention protrusion 76 that will be described below, to distinguish the elastic support portion 80 provided on the insertion prevention protrusion 72 from the elastic support portion 80 provided on the separation prevention protrusion 76, the elastic support portion 80 provided on the insertion prevention protrusion 72 may be referred to as first elastic support portions 81 and 110, and the elastic support portion 80 provided on the separation prevention protrusion 76 may be referred to as second elastic support portions 82 and 110.

The elastic support portion 80 is configured so that the insertion prevention protrusion 72 and the separation prevention protrusion 76 that will be described below are elastically provided on the display unit 60. The elastic support portion 80 is provided to support the coupling protrusions 70 from the side surface portion 60*c* of the display unit 60 and is provided so that both sides of the elastic support portion 80 in a lengthwise direction of the elastic support portion 80 may be spaced apart from the side surface portion 60*c* of the display unit 60, and thus the elastic support portion 80 may elastically support the coupling protrusions 70.

Through this configuration, when the display unit 60 is detached from the display case 100, the coupling protrusions 70 are provided to elastically move to inner and outer sides of the display unit 60.

The separation prevention protrusion 76 is provided so that, after the display unit 60 is mounted on the display case 100, rotation of the display unit 60 does not easily occur and the display unit 60 can be solidly mounted on the display case 100.

In detail, in the current embodiment of the present disclosure, the display unit 60 is provided to be separable from the display case 100 or the door 20 when rotation of the display unit 60 occurs due to the pressed first portion 61. In order to prevent rotation of the display unit 60 caused by the pressing force in which the user touches the touchpad, the display unit 60 is provided so that force is exerted in an opposite direction to a direction in which a separation force is generated in the second portion 62 due to the pressing force applied to the first portion 61 of the display unit 60. Through this configuration, rotation of the display unit 60 does not freely occur, and the display unit 60 is provided to be solidly mounted on the display case 100.

For this reason, the separation prevention protrusion 76 may include a separation prevention hanging jaw 77.

The separation prevention hanging jaw 77 may be formed to be bent from the display unit 60 and to face the outer side of the door 20. The separation prevention hanging jaw 77 is configured to prevent the second portion 62 of the display unit 60 from being easily separated from the display case 100 or the door 20. In detail, the separation prevention hanging jaw 77 is provided so that, only when the separation prevention hanging jaw 77 is hung in the case hanging jaw 126 of the display case 100 and a predetermined pressing force or more is generated in the first portion 61, the second portion 62 of the display unit 60 can be separated from the display case 100 or the door 20. In the current embodiment of the present disclosure, the separation prevention hanging jaw 77 is provided perpendicular to the separation direction of the display unit 60. However, embodiments of the present disclosure are not limited thereto, and the separation prevention hanging jaw 77 may be provided to prevent insertion of the first portion 61 of the display unit 60.

Also, the separation prevention protrusion 76 may include the protrusion inclination surface 78. The protrusion inclination surface 78 may be provided to protrude from the side surface portion 60*c* to be inclined with respect to a direction in which the display unit 60 is separated from the door 20. If the protrusion inclination surface 78 formed on the insertion prevention protrusion 72 and the protrusion inclination surface 78 formed on the separation prevention protrusion 76 need to be distinguished from each other, the protrusion inclination surface 78 of the insertion prevention protrusion 72 may be referred to as a first protrusion inclination surface 78*a*, and the protrusion inclination surface 78 of the separation prevention protrusion 76 may be referred to as a second protrusion inclination surface 78*b*.

The separation prevention protrusion 76 may be provided to protrude directly from the display unit 60. In the current embodiment of the present disclosure, the elastic support portion 80 may be provided to elastically support the separation prevention protrusion 76. As described above, if the elastic support portion 80 formed on the separation prevention protrusion 76 and the elastic support portion 80 formed on the insertion prevention protrusion 72 need to be distinguished from each other, the elastic support portion 80 provided on the separation prevention protrusion 76 may be referred to as second elastic support portions 82 and 110.

Arrangement of the insertion prevention protrusion 72 and the separation prevention protrusion 76 is not limited thereto, and in the current embodiment of the present disclosure, the insertion prevention protrusion 72 may be provided on at least the first portion 61 of the first portion 61 and the second portion 62 of the display unit 60, and the separation prevention protrusion 76 may be provided on at least the second portion 62 of the first portion 61 and the second portion 62 of the display unit 60. Arrangement positions of the insertion prevention protrusion 72 and the separation prevention protrusion 76 are not limited to the first portion 61 and the second portion 62. In the current embodiment of the present disclosure, the insertion prevention protrusion 72 is provided on an upper part of the display unit 60, i.e., the top surface portion 60*d* of the display unit 60, and a plurality of separation prevention protrusions 76 are provided along the side surface portion 60*c* except the top surface portion 60*d* of the display unit 60.

The display case 100 may include at least one coupling groove 120 to correspond to the coupling protrusions 70 of the display unit 60. In detail, the case side surface 104 of the display case 100 may include at least one coupling groove 120 to correspond to the coupling protrusions 70 of the display unit 60.

Each of the coupling grooves 120 may include an insertion prevention groove 122 corresponding to the insertion prevention protrusion 72 and a separation prevention groove 124 corresponding to the separation prevention protrusion 76.

The insertion prevention groove 122 and the separation prevention groove 124 may include the case hanging jaw 126 to correspond to the insertion prevention hanging jaw 73 and the separation prevention hanging jaw 77, respectively. In detail, the insertion prevention groove 122 and the separation prevention groove 124 may include a first case hanging jaw 126*a* corresponding to the insertion prevention hanging jaw 73 and a second case hanging jaw 126*b* corresponding to the separation prevention hanging jaw 77.

The first case hanging jaw 126*a* may be provided to face the outer side of the door 20 to correspond to the insertion prevention hanging jaw 73, and the second case hanging jaw 126*b* may be provided to face the inner side of the door 20 to correspond to the separation prevention hanging jaw 77.

Hereinafter, an operation of separating the display assembly 50 of the refrigerator 1 illustrated in FIG. 1 will be described.

FIGS. 7, 8, 9, and 10 illustrate an operation of separating the display assembly 50 of the refrigerator 1 of FIG. 1.

Figure 7:
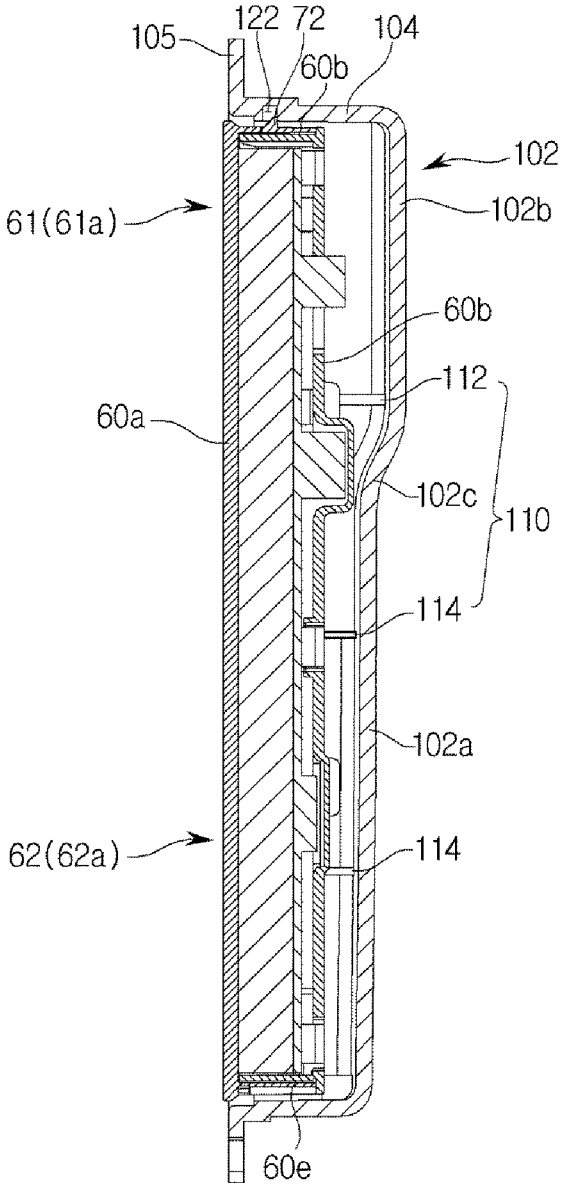
FIGS. 7, 8, 9, and 10 illustrate an operation of separating the display assembly of the refrigerator of FIG. 1.

FIG. 7 illustrates an operation in which the display unit 60 is mounted on the display case 100 or the door 20.

The rear surface portion 60*b* of the display unit 60 is supported by the support portion 110, and the side surface portion 60*c* of the display unit 60 is supported by the insertion prevention protrusion 72 provided on the insertion prevention groove 122 and the separation prevention protrusion 76 provided on the separation prevention groove 124.

In detail, based on FIG. 7, the display unit 60 is rotated clockwise based on a point in which the rotation support portion 112 and the display unit 60 contact each other, for separation of the display unit 60. Before an external force is generated, in order to prevent rotation of the display unit 60, the insertion prevention hanging jaw 73 and the first case hanging jaw 126*a* contact each other, and the separation prevention hanging jaw 77 and the second case hanging jaw 126*b* contact each other, and the rear surface portion 60*b* of the display unit 60 is supported by each of the mounting support portions 114.

Figure 8:
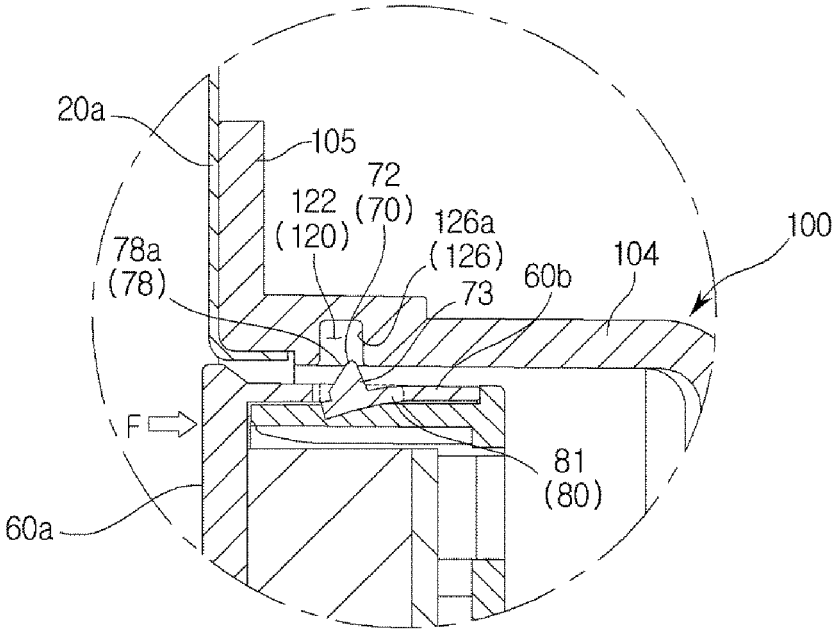
Figure 9:
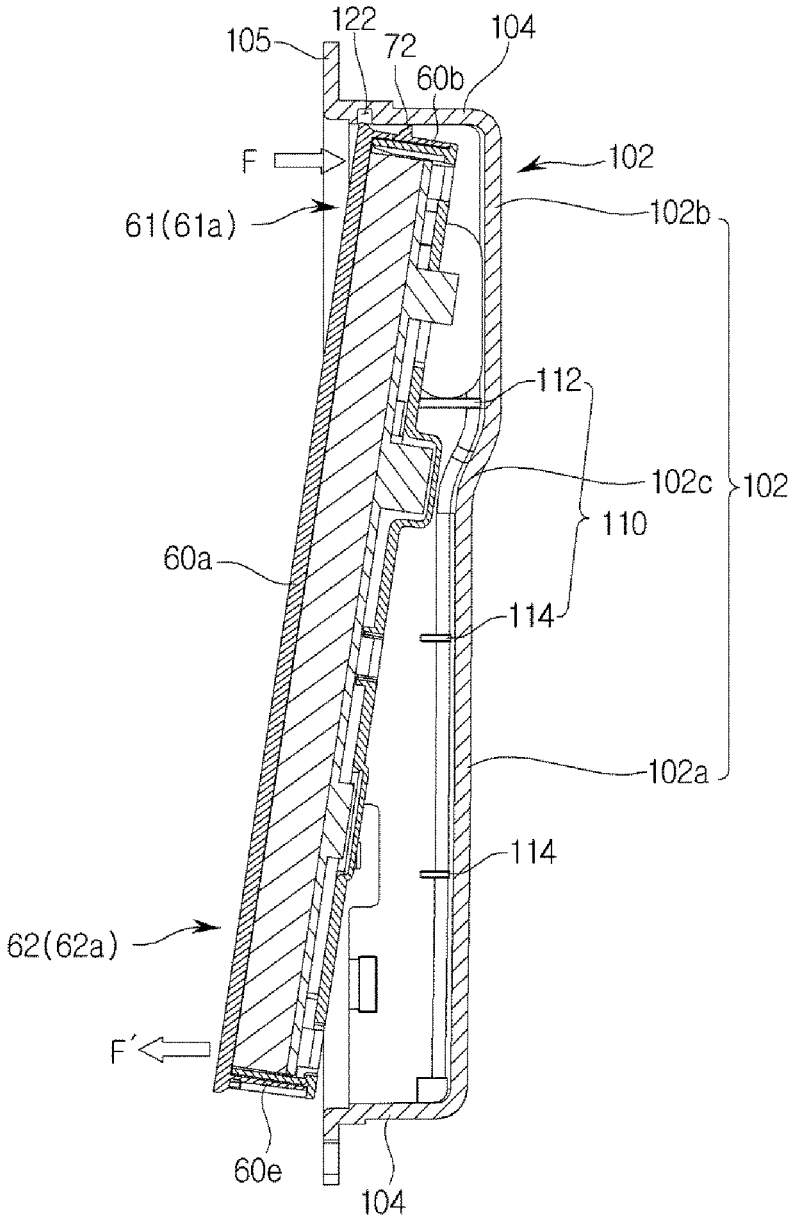
Figure 10:
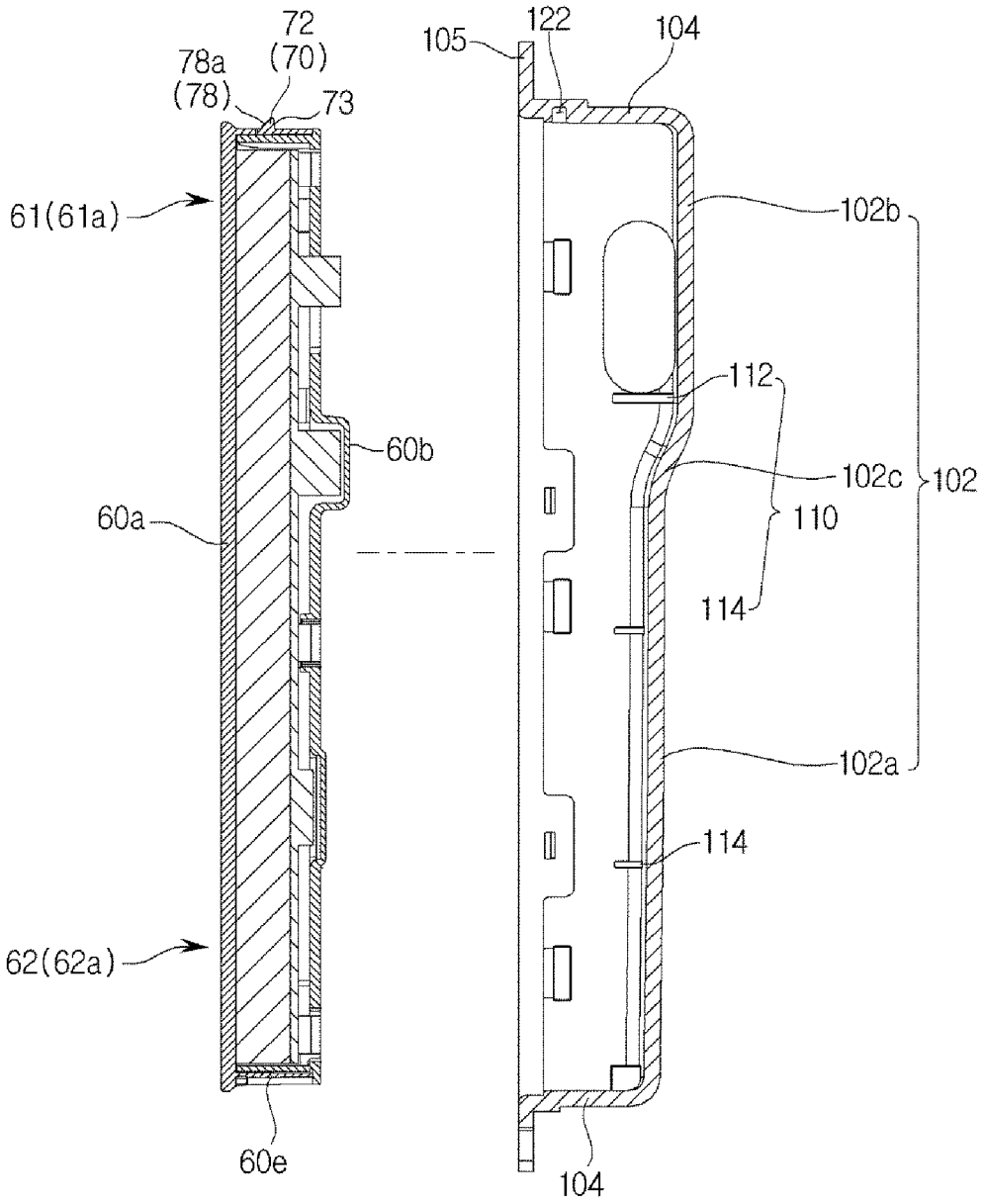

FIGS. 8, 9, and 10 illustrate an operation in which the separation pressing force F for separation of the display unit 60 is applied to the first portion 61 of the display unit 60.

The separation pressing force F is exerted so that the first portion 61 is pushed into the rotation space 108 and the first portion 61 faces the second bottom surface 102*b*. That is, the first portion 61 is pressed toward the second bottom surface 102*b* so that rotation of the display unit 60 occurs.

The display unit 60 is rotated in such a way that, at the rear side of the display unit 60, due to the rotation support portion 112, the first portion 61 of the display unit 60 is inserted into the case bottom surface 102 and the second portion 62 of the display unit 60 rotates away from the case bottom surface 102.

That is, a force F' is generated in the second portion 62 in a direction in which the display unit 60 is separated from the display case 100 due to a principle of a lever.

The insertion prevention hanging jaw 73 of the insertion prevention protrusion 72 is hung in the case hanging jaw 126 and prevents free insertion, and the separation prevention hanging jaw 77 of the separation prevention protrusion 76 is hung in the case hanging jaw 126 and prevents free separation. When a larger separation pressing force F is exerted than the disturbing force, the insertion prevention hanging jaw 73 and the separation prevention hanging jaw 77 are respectively separated from the case hanging jaw 126. As a result, the display unit 60 is separated from the display case 100.

In detail, due to the separation pressing force F, an external force is exerted on the insertion prevention protrusion 72 such that elastic movement of the first elastic support portion 81 occurs and the insertion prevention protrusion 72 is separated from the case hanging jaw 126, and an external force is also exerted on the separation prevention protrusion 76 such that elastic movement of the second elastic support portion 82 occurs and the separation prevention protrusion 76 is separated from the case hanging jaw 126.

Through this procedure, the display unit 60 can be separated from the display case 100.

As described above, in a refrigerator according to the present disclosure, a display unit can be easily detached from a door of the refrigerator without an additional configuration. Also, no gap is formed between the display unit and the door for separation of the display unit so that an aesthetic appeal of the refrigerator can be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body having a storage compartment;

a door that opens or closes the storage compartment;

a display case having a first recess formed in a front side of the door to a first depth, a second recess formed in the front side of the door to a second depth greater than the first depth, and a rotation support portion provided to be adjacent to a border between the first recess and the second recess; and a display unit having a first portion corresponding to the second recess and a second portion corresponding to the first recess, and provided to be completely separable from the display case, wherein the display unit is provided to be rotatable on the rotation support portion by a lever so that the first portion is inserted into the second recess and the second portion is protruded from the first recess.

2. The refrigerator of claim 1, wherein the display case further comprises a mounting support portion which is provided on the first recess and on which at least a portion of a rear side of the display unit is mounted.

3. The refrigerator of claim 1, wherein the display unit comprises a coupling protrusion through which the display unit is combined with the display case.

4. The refrigerator of claim 3, wherein the coupling protrusion comprises an insertion prevention protrusion that is formed to be inclined from the display unit and has an insertion prevention hanging jaw formed to face the inner side of the door.

5. The refrigerator of claim 4, wherein the insertion prevention protrusion is provided in the first portion.

6. The refrigerator of claim 3, wherein the coupling protrusion comprises a separation prevention protrusion that is formed to be inclined from the display unit and has a separation prevention hanging jaw formed to face an outer side of the door.

7. The refrigerator of claim 6, wherein the separation prevention protrusion is provided in the second portion.

8. The refrigerator of claim 3, wherein the display case further comprises:

a case bottom surface formed to face a rear surface portion of the display unit;

a case side surface that connects the case bottom surface and the front side of the door; and a coupling groove provided in the case side surface to correspond to the coupling protrusion.

9. The refrigerator of claim 1, wherein the display unit comprises a front surface portion, and the front surface portion is provided parallel to the front side of the door.

10. The refrigerator of claim 1, wherein the display case further comprises a case opening provided in the front side of the door and formed to be opened or closed by the display unit, and a width of the case opening corresponds to a width of a front surface portion of the display unit.

11. A refrigerator comprising:

a body having an opening formed therein;

a door that opens or closes the opening; and a display assembly provided at a front side of the door, wherein the display assembly comprises:

a display case having a first recess formed in a front side of the door to a first depth, a second recess formed in the front side of the door to a second depth greater than the first depth, and a rotation support portion provided to be adjacent to a border between the first recess and the second recess; and a display unit having a first portion corresponding to the second recess and a second portion corresponding to the first recess, and provided to be completely separable from the display case, wherein the display unit is provided to be rotatable on the rotation support portion by a lever so that the first portion is inserted into the second recess and the second portion is protruded from the first recess.

12. The refrigerator of claim 11, wherein the display case comprises a case bottom surface having a first bottom surface formed to the first depth with respect to the front side of the door and a second bottom surface formed to the second depth that is larger than the first depth.

13. The refrigerator of claim 12, wherein the rotation support portion protrudes from the case bottom surface and supports a rotation of the display unit, and the display unit comprises:

a rotation insertion portion mounted on a front of the second bottom surface; and a rotation protrusion portion that is provided parallel to the rotation insertion portion in a lengthwise direction of the display unit and mounted on a front of the first bottom surface.

14. The refrigerator of claim 13, wherein the display unit is rotated when an external force is applied to the rotation insertion portion toward the second bottom surface.

15. The refrigerator of claim 13, wherein the display unit further comprises an insertion prevention protrusion that is formed to be inclined from the rotation insertion portion and has an insertion prevention hanging jaw formed to face an inner side of the door.

16. The refrigerator of claim 13, wherein the display unit further comprises a separation prevention protrusion that is formed to be inclined from the rotation protrusion portion and has a separation prevention hanging jaw formed to face a front of the door.

17. A refrigerator comprising:

a storage compartment;

a door to provide access to the storage compartment and having a first recess formed in a front portion of the door to a first depth, a second recess formed in the front portion of the door to a second depth greater than the first depth, and a rotation support portion provided to be adjacent to a border between the first recess and the second recess; and a display having a first portion corresponding to the second recess and a second portion corresponding to the first recess, and provided to be completely separable from the door, wherein the display is provided to be rotatable on the rotation support portion by a lever so that the first portion is inserted into the second recess and the second portion is protruded from the first recess.

* * * * *